US005522373A

United States Patent [19]

Barnett

[11] Patent Number: 5,522,373

[45] Date of Patent: Jun. 4, 1996

[54] CROSS BOW

[75] Inventor: Bernard T. Barnett, Shifnal, United Kingdom

[73] Assignee: Barnett International Limited, Wolverhampton, United Kingdom

[21] Appl. No.: 279,422

[22] Filed: Jul. 25, 1994

[30] Foreign Application Priority Data

Jan. 7, 1994 [GB] United Kingdom ..... 9400223

[51] Int. Cl.[6] ..... F41B 5/12

[52] U.S. Cl. ..... 124/25; 124/23.1

[58] Field of Search ..... 124/25, 23.1, 25.5; 403/321, 322

[56] References Cited

U.S. PATENT DOCUMENTS

| | | | |
|---|---|---|---|
| 214,791 | 4/1879 | Randall | 124/25 |
| 537,817 | 4/1895 | Coates | 124/25 |
| 2,842,114 | 7/1958 | Duncan . | |
| 4,002,236 | 1/1977 | Tolleson . | |
| 4,294,222 | 10/1981 | Pelsue . | |
| 4,545,358 | 10/1985 | Collins | 124/25 X |
| 4,587,944 | 5/1986 | Barnett | 124/25 |
| 4,716,880 | 1/1988 | Adkins | 124/25 |
| 4,926,834 | 5/1990 | Chauvin . | |
| 5,025,771 | 6/1991 | Hanson | 124/25 |

FOREIGN PATENT DOCUMENTS

| | | |
|---|---|---|
| 792601 | 1/1936 | France . |
| 175303 | 5/1935 | Switzerland . |
| 2131706 | 6/1984 | United Kingdom . |

*Primary Examiner*—Anthony Knight
*Attorney, Agent, or Firm*—Pettis & McDonald

[57] ABSTRACT

The fore-end (12) of a crossbow stock is provided with a detachable prod (10) slidably engageable with and disengageable from the fore-end. A releasable lock in the form of a toggle linkage is provided for detachably securing the prod to the fore-end. Hook ends (50) on linkage arms (44) carried by the prod are engageable with pin connectors (52) on the fore-end. The toggle linkage includes an operating handle in the form of a stirrup (36) which projects forwardly of the prod when the linkage is in its locking position securing the prod to the stock.

7 Claims, 2 Drawing Sheets

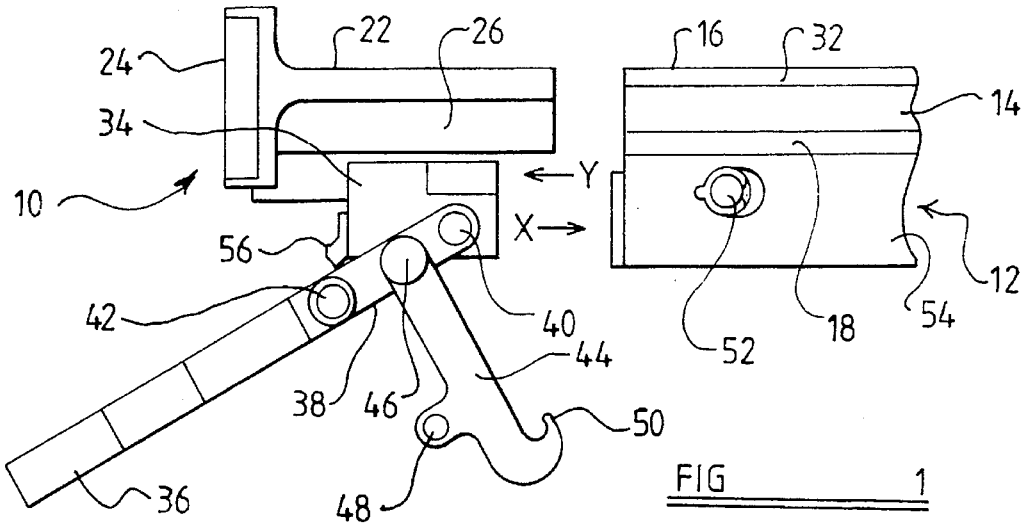
FIG 1
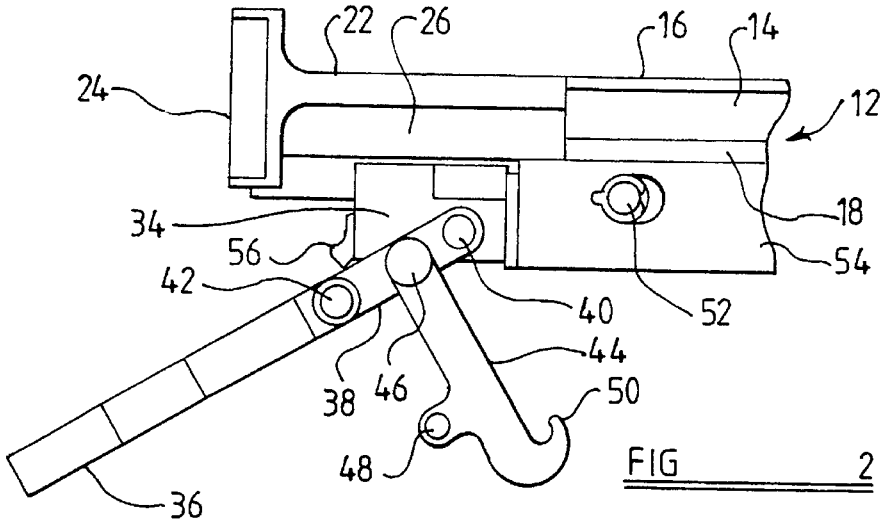
FIG 2
FIG 3
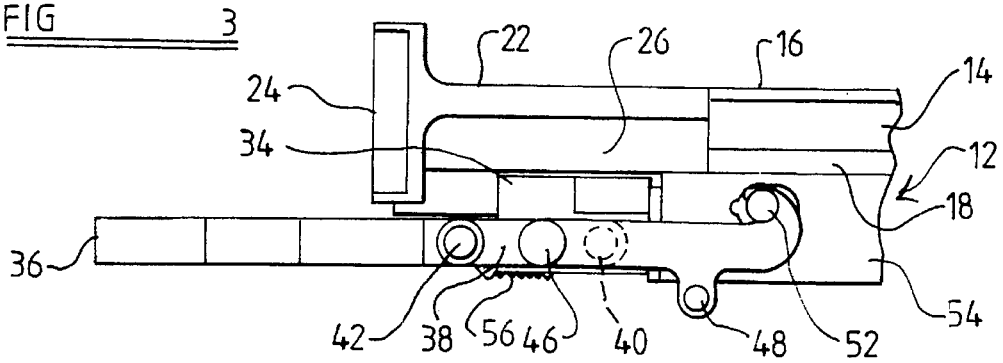

FIG 4
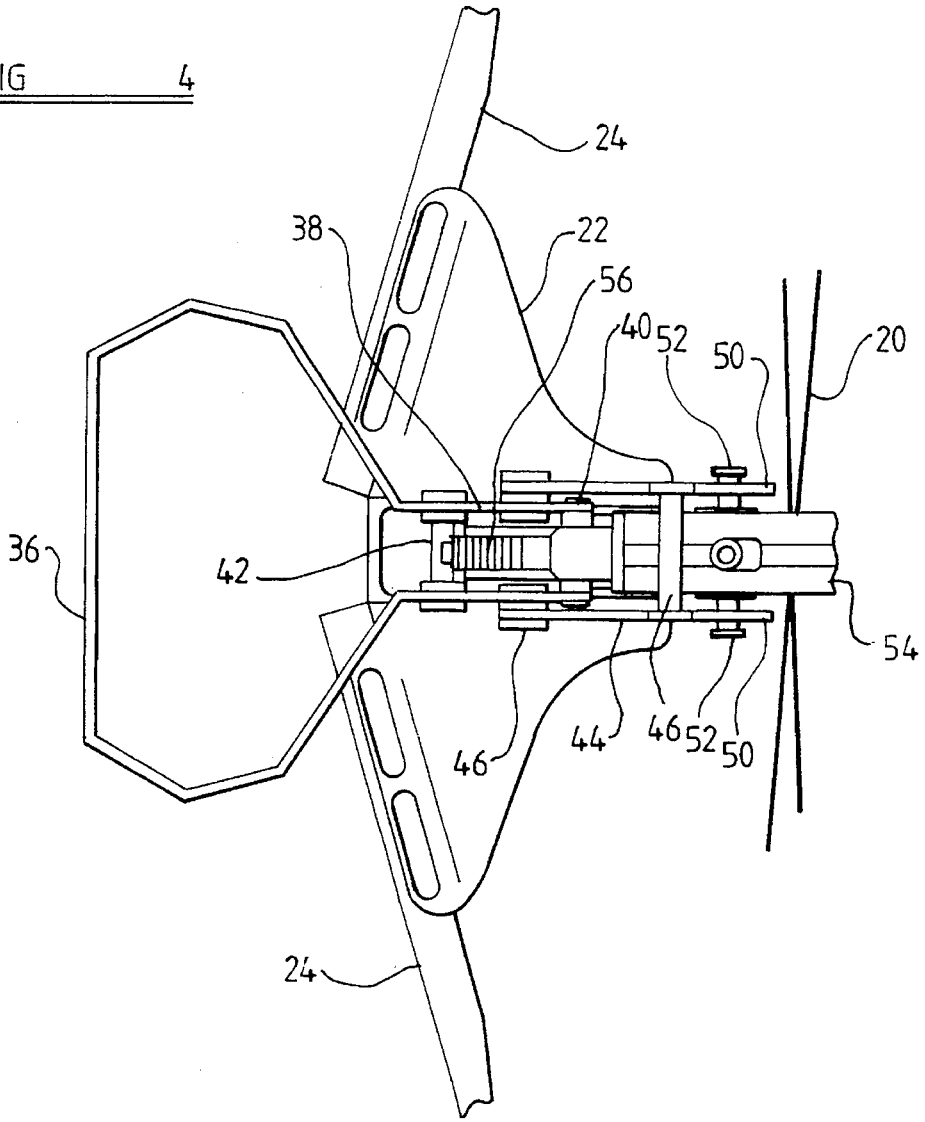
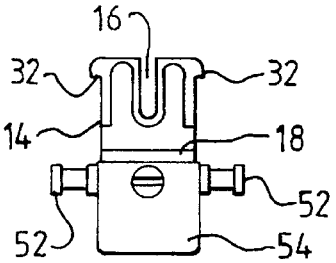
FIG 5
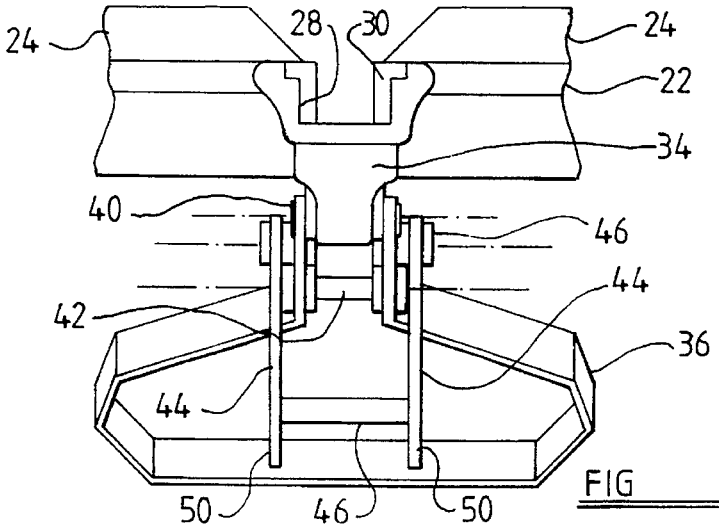
FIG 6

CROSS BOW

BACKGROUND TO THE INVENTION

This invention relates to a crossbow of the type comprising a stock having a fore-end portion supporting a bow prod which extends transversely of the length of the stock and which has a bow string extending across the stock between opposite ends of the prod.

A crossbow is unwieldy to transport from place to place by virtue of its inherent design features of a relatively long stock and a relatively long prod supported to extend transversely of the stock. Although the prod is usually secured to the fore-end of the stock by a screw-threaded bolt it is not the intention that the bolt should be unscrewed and the prod removed from the stock to facilitate transportation; the prod is assembled to the stock by means of the bolt without subsequent disassembly being intended, apart perhaps for repair or replacement purposes.

In GB-A-2 131 706 it has been proposed to render a crossbow more compact for transportation purposes by providing the prod in two parts for pivoting relative to one another and to the stock.

It is an object of the present invention to provide a crossbow comprising a stock and a prod which can be carried together in a compact configuration.

SUMMARY OF THE INVENTION

In accordance with the invention there is provided a crossbow comprising a stock having a fore-end and a bow prod wherein the prod is engageable with and disengageable from the fore-end of the stock, releasable locking means being engageable between the prod and the stock and being movable between a locking position in which the locking means retains the prod engaged with the fore-end of the stock and a release position in which the prod is disengageable from the fore-end of the stock permitting removal of the prod from the stock.

The provision of such releasable locking means enables ready assembly or disassembly of the prod with the stock for use or for transportation respectively.

Preferably the prod is slidably engageable with and slidably disengageable from the fore-end of the stock and conveniently the prod may include a hollow body element slidably engageable over a co-operating element of the fore-end of the stock.

The releasable locking means conveniently comprises linkage means mounted on the prod and being releasably connectable to connector means on the stock and the linkage means may include a stirrup which in said locking position of said linkage means extends in a direction longitudinally of the stock beyond the fore-end thereof.

The linkage means conveniently comprises a toggle action linkage including hook members releasably connectable to connector means on the stock and said linkage means may comprise two transversely spaced hook arms each having a hook-like extremity connectable to a respective co-operating pin member on the stock, said hook arms being interconnected for movement in unison with one another upon actuation of said toggle linkage.

Said toggle linkage may include an actuating member in the form of a said stirrup which in said locking position of said linkage means extends in a direction longitudinally of the stock beyond the fore-end thereof.

BRIEF DESCRIPTION OF THE DRAWINGS

Other features of the invention will become apparent from the following description given herein solely by way of example with reference to the accompanying drawings wherein:

FIG. 1 is a somewhat diagrammatic side elevation showing part of the fore-and of the stock of a crossbow constructed in accordance with the invention with the prod detached therefrom;

FIG. 2 is a similar side elevation showing the prod engaged with the fore-end stock with the linkage in its release position;

FIG. 3 is a similar view to that of FIG. 2 showing the linkage in its locking position;

FIG. 4 is an underneath plan view of the prod and fore-end of the crossbow in the engaged and locked position of FIG. 3;

FIG. 5 an end elevation of the fore-end of the stock taken in the direction of arrow X of FIG. 1; and FIG. 6 is an end elevation of the prod taken in the direction of arrow Y of FIG. 1.

DESCRIPTION OF THE PREFERRED EMBODIMENTS

Referring firstly to FIG. 1 of the drawings there is shown the bow prod 10 of a crossbow detached from the fore-end 12 of the crossbow stock. The remainder of the stock may be of conventional elongated form including a butt and trigger mechanism arranged in a known manner. An upper part 14 of the stock provides a guide surface for guiding a bolt (not shown) in a rectilinear groove 16 when the bolt is fired from the crossbow in a known manner. A slot 18 extends rearwardly of the end of the fore-end 12 for receiving single or multiple bow strings 20 when the prod 10 is engaged with the fore-end 12 of the stock as further described below.

The bow prod 10 comprises a prod body 22 of web-like form supporting a prod proper in two identical parts 24 extending symmetrically on either side of the longitudinal axis of the prod body. An upper part 26 of the body is of generally channel-shaped configuration having opposed side walls 28 whereby the body part 26 may be slidably engaged over the correspondingly profiled upper part 14 of the stock fore-end. Each side wall 28 of the body part 26 is provided with an elongate recess 30 at its upper edge within which engages a respective co-operating elongate lip 32 provided at the upper outer edge of the upper part 14 of the stock fore-end 12 when the prod is slid onto the fore-end.

A lower body part 34 of the prod carries releasable locking means thereon whereby when the prod 10 is slidably engaged upon the fore-end 12 of the stock as shown in FIG. 2, the means may be moved to a locking position for retaining the prod securely on the fore-end. Said means comprises a toggle action linkage having an actuating member in the form of a stirrup handle 36 and two parallel side arms 38 of the stirrup pivotally mounted by pivot pins 40 to the lower body part 34 of the prod. A pin 42 extends transversely to interconnect the two arms 38 at a position remote from the pivot pins 40 and adjacent the stirrup 36. A pair of hook arms 44 are pivotally mounted upon the linkage, each said hook arm 44 being pivotally mounted at 46 intermediate the ends of a respective arm 38 with the two hook arms 44 being interconnected by an offset transversely extending pin 48 whereby the hook arms 44 are movable in unison relative to the side arms 38.

The free end of each hook arm 44 is provided with a hook formation 50 for engagement about a respective pin member 52 extending transversely from a respective side of a lower part 54 of the fore-end 12. Each pin member conveniently comprises a disc-like head and a neck of reduced diameter about which each respective hook formation 50 may be engaged as shown in FIG. 3 of the drawings. The two pin members 52 are disposed coaxially with one another and are adjustably mounted for limited movement longitudinally of the fore-end 12 by means of a block mechanism (not shown) located within the lower part 54 of the fore-end.

Thus to assemble the prod 10 to the stock fore-end 12 from the position shown in FIG. 1, the upper part 26 of the prod body 22 is slidably engaged on the upper part 14 of the fore-end and the prod and fore-end are slid together relative to one another until the rear face of the lower body part 34 of the prod abuts the end of the lower part 54 of the fore-end as shown in FIG. 2. The hook arms 44 are then swung upwardly so as to be locatable respectively about each pin member 52 when the stirrup handle 36 of the linkage mechanism is pivoted upwardly to the locking position shown in FIG. 3. During movement of the stirrup handle 36 to the FIG. 3 position, the hook formations 50 pull upon the respective pin members 52 so as to force the prod and the stock into rigid abutment with one another. As shown in FIG. 3, the side arms 38 and the hook arms 44 are parallel to one another although as is known with a toggle action linkage of this type, the arms 38 and 44 may pass beyond their parallel relationship to a slightly over centre position. In the locking position the offset pin 48 abuts the undersurface of the lower part 54 of the fore-end 12 and the pin 42 is engaged behind an end of a spring loaded latch 56 thereby preventing the linkage from moving from its locking position.

When it is desired to disassemble the prod 10 from the stock the latch 56 is manually slid rearwardly of the crossbow under finger pressure permitting the stirrup handle 36 to be pivoted downwardly about its pivot pins 40 whereby the hook arms 44 will be moved rearwardly relative to the fore-end 12. The hook arms 44 may then be pivoted downwardly to the position shown in FIG. 2 at which time the prod 10 may be slidably disengaged from the fore-end 12.

It will be understood that a bow string 20 is connected between opposed ends of the two prod parts 24 and, in known manner, such bow string may comprise a principal run engageable with the bolt to be fired from the crossbow and subsidiary runs which are connected via pulleys to the principal run. When the prod 10 is slidably engaged with the fore-end 12 of the stock the lower subsidiary runs are engaged within the slot 18 which extends rearwardly from the end of the fore-end 12 whilst the principal run is positioned above the upper surface of the fore-end. When the crossbow is in use with the linkage in the locking position shown in FIG. 3, the stirrup 36 extends forwardly of the crossbow for engagement by the foot of a user in known manner with the crossbow in a substantially vertical orientation whereby the principal run of the bow string may be pulled upwardly into a latched position ready for firing a bolt.

Thus the invention provides a crossbow comprising a readily separable prod and stock which may be disassembled for transportation together in a compact configuration and which may be readily re-assembled in a secure, rigidly locked together manner for use.

I claim:

1. A crossbow comprising a stock having a fore-end and a bow prod wherein the prod includes a hollow body element slidably engageable over a co-operating element of the fore-end of the stock and is engageable with and disengageable from the fore-end of the stock, releasable locking means being engageable between the prod and the stock and being movable between a locking position in which the locking means retains the prod engaged with the fore-end of the stock and a release position in which the prod is disengageable from the fore-end of the stock permitting removal of the prod from the stock.

2. A crossbow as claimed in claim 1 wherein said releasable locking means comprises a linkage means.

3. A crossbow as claimed in claim 2 wherein the linkage means is mounted on the prod and is releasably connectable to connector means on the stock.

4. A crossbow as claimed in claim 2 wherein the linkage means includes a stirrup which in said locking position of said linkage means extends in a direction longitudinally of the stock beyond the fore-end thereof.

5. A crossbow as claimed in claim 2 wherein said linkage means comprises a toggle action linkage including hook members releasably connectable to connector means on the stock.

6. A crossbow as claimed in claim 5 wherein said linkage means comprises two transversely spaced hook arms each having a hook-like extremity connectable to a respective co-operating pin member on the stock, said hook arms being interconnected for movement in unison with one another upon actuation of said toggle linkage.

7. A crossbow as claimed in claim 5 wherein said toggle linkage includes an actuating member in the form of a stirrup which in said locking position of said linkage means extends in a direction longitudinally of the stock beyond the fore-end thereof.

* * * * *